United States Patent [19]

Klepfer

[11] 4,306,316

[45] Dec. 22, 1981

[54] DISPOSABLE PROTECTIVE GARMENT

[76] Inventor: Harlan A. Klepfer, 16 Meadowstream Ct., Snyder, N.Y. 14226

[21] Appl. No.: 127,583

[22] Filed: Mar. 6, 1980

Related U.S. Application Data

[63] Continuation-in-part of Ser. No. 103,486, Dec. 14, 1979.

[51] Int. Cl.[3] ..... A41B 13/10

[52] U.S. Cl. ..... 2/48

[58] Field of Search ..... 2/48–52

[56] References Cited

U.S. PATENT DOCUMENTS

| | | | |
|---|---|---|---|
| 2,030,135 | 2/1936 | Carpenter | 24/67 R |
| 2,109,583 | 3/1938 | Bennett | 428/191 |
| 2,142,194 | 1/1939 | Karfiol | 206/447 |
| 2,424,680 | 7/1947 | Doyle | 2/52 |
| 2,523,565 | 9/1950 | Gardner | 73/493 |
| 2,755,576 | 7/1956 | Golden | 40/10 R |
| 3,443,288 | 5/1969 | Batchelder et al. | 24/67 R |
| 3,654,059 | 4/1972 | Zisblatt | 428/41 |
| 3,875,621 | 4/1975 | Karami | 24/67 R |
| 3,884,443 | 5/1975 | McMaster | 248/467 |
| 3,948,258 | 4/1976 | Karami | 128/287 |
| 4,009,784 | 3/1977 | Elias | 211/46 |

FOREIGN PATENT DOCUMENTS

| | | |
|---|---|---|
| 1148145 | 4/1969 | United Kingdom . |
| 1175457 | 12/1969 | United Kingdom . |

*Primary Examiner*—Doris L. Troutman

*Attorney, Agent, or Firm*—Christel, Bean & Linihan

[57] ABSTRACT

A disposable bib, napkin or apron of flexible sheet material having a neck cutout in its upper edge portion and two shoulder pieces adjacent the cutout. The upper edge portion carries a pressure-sensitive adhesive capable of releasably adhering to itself and to the clothing or body of a user, the adhesive extending substantially continuously across substantially the entire upper edge portion of the garment, leaving upper side edge portions free of adhesive, and extending downwardly for an appreciable distance to below the cutout. The garment is folded upon itself prior to use with one portion of the adhesive contacting and overlying another portion thereof whereby the entire area of adhesive is covered by the garment itself. To prepare the garment for use, the adhesive-free upper side edge portions are pulled apart to open the garment and expose the adhesive for placement against the clothing or body of a user. The pressure-sensitive adhesive can be carried on a tape extending across the upper edge portion or applied directly to the material of the garment body.

17 Claims, 14 Drawing Figures

Fig. 10.
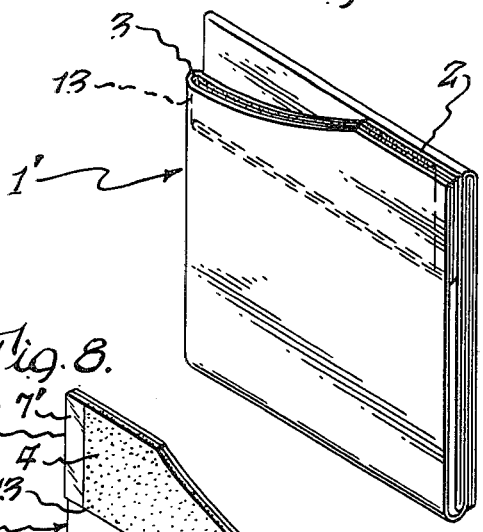
Fig. 9.
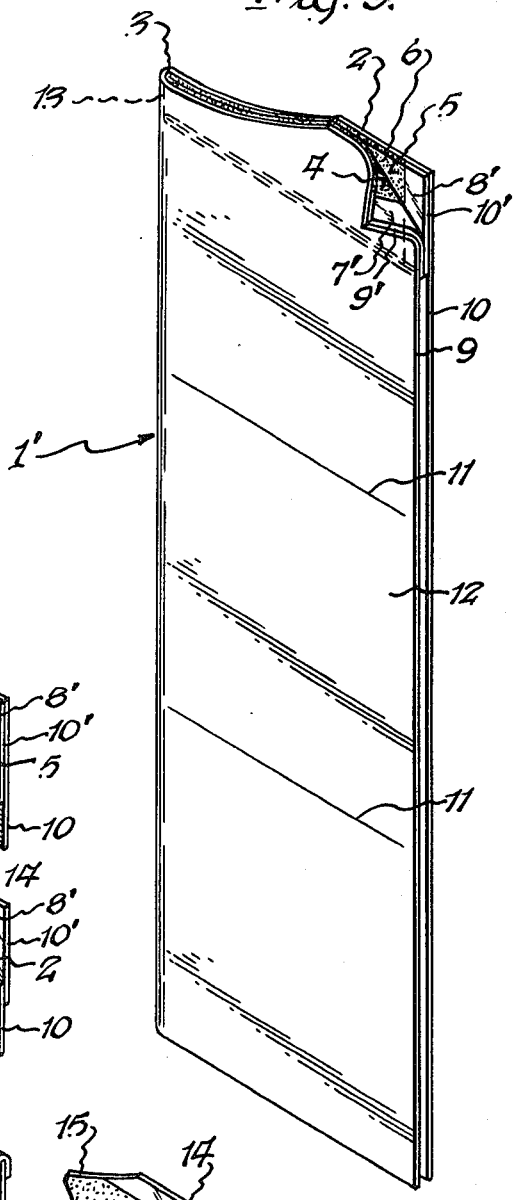
Fig. 8.
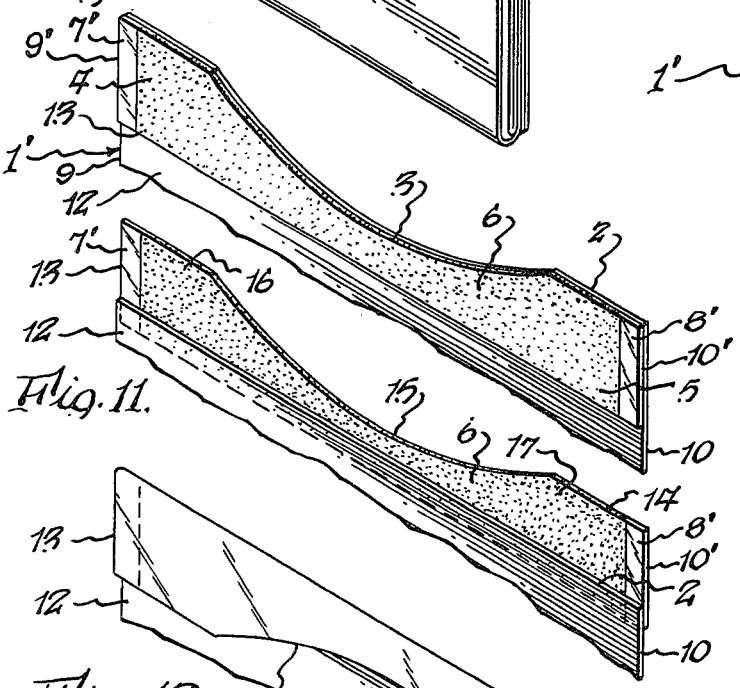
Fig. 11.
Fig. 12.
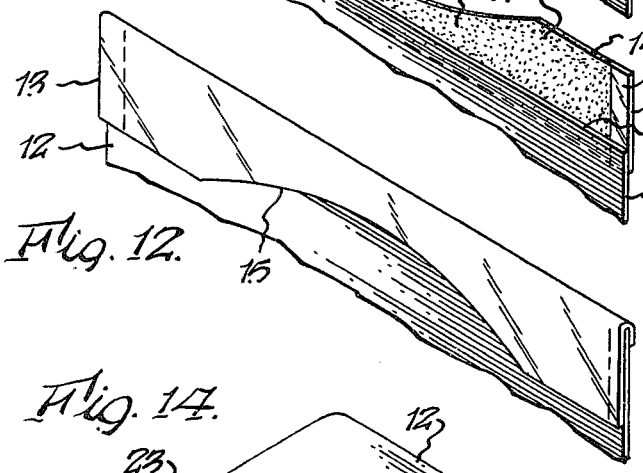
Fig. 13.
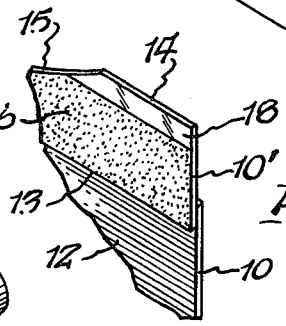
Fig. 14.
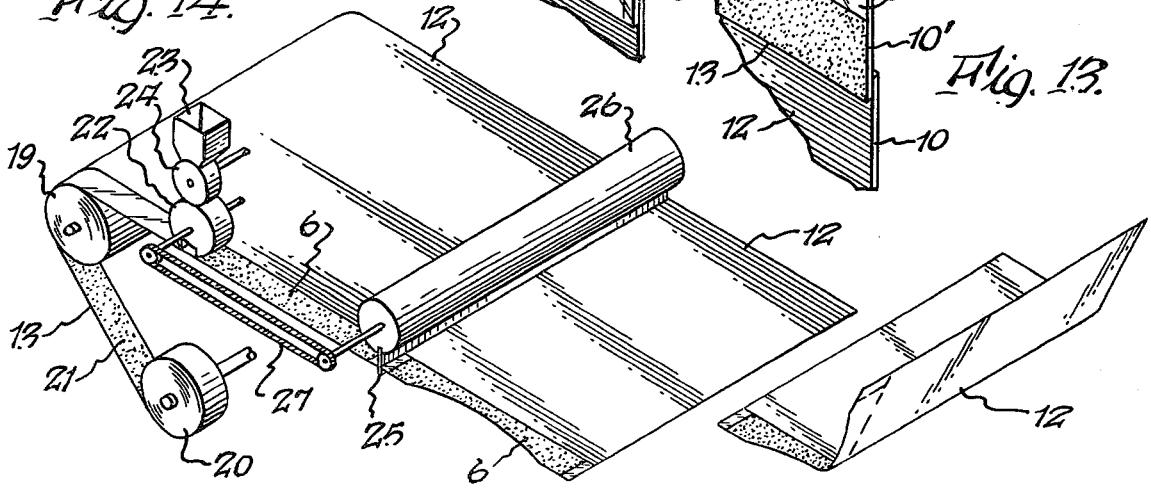

DISPOSABLE PROTECTIVE GARMENT

CROSS REFERENCE TO RELATED APPLICATION

This application is a continuation-in-part of my pending application Ser. No. 103,486 filed Dec. 14, 1979.

BACKGROUND OF THE INVENTION

This invention relates to a disposable bib, napkin or mini-apron adapted to be fastened generally to the upper portion of the wearer's clothing to protect the same.

To the hospitalized and the aged, where self feeding is important, protecting clothing during meal times is a real problem. Protective bibs or napkins having adhesive attachment means are old and are described, for example, in U.S. Pat. Nos. 2,009,831, 2,402,734, 2,617,104, 2,902,734, 3,332,547, 3,416,157, 3,675,274, 3,871,027, 3,995,321 and 3,979,776. However, in some prior art constructions, the adhesive portions are present in relatively small areas, which can tear away from gauze-like paper, and which can leave gaps with resulting loss of protection against soiling. Others have portions which extend behind the wearer or over his shoulder. To fasten such bibs or napkins is frequently beyond the capabilities of persons having limited motor ability in their arms, wrists, or fingers, as for example, victims of rheumatoid or osteoarthritis, the blind or many nursing home residents. The present invention is self attachable by many persons as above described who would have difficulty or find use impossible with prior art articles. Only limited motion is required for attachment with the article described herein.

The present invention has great utility in nursing and retirement homes, where many of the elderly residents suffer from arthritic conditions and other afflictions resulting in impaired motor abilities. For them to be able to attach a bib to their clothing by themselves, without the aid of an attendant, would lessen the work load on the staff as well as protect clothing which would cut down laundry time and expense.

In addition to helping morale by being more self sufficient research in the matter has shown a reluctance for the aged to have anything fastened around their necks while eating. They prefer a situation where they can function independantly and are not reduced to "children" with around the neck "child bibs".

The present invention has utility wherever a self adhering, disposable protective garment characterized by simplicity and ease of application is needed or desirable. It would be useful, for example, on airplanes where space constraints limit the mobility of the user and the likelihood of spilling is increased.

SUMMARY

It is the general object of this invention to provide a self-adhering disposable bib, napkin or mini-apron which is free from snaps, ties, strings and the like, which is easily attached to a wearer's clothing by oneself and does not require extensive stretching or movement of arms, wrists or fingers or eye sight for doing so, and which is constructed and arranged to be its own protective cover prior to use, without need for a removable overlay or tear-off strips which can create a litter problems.

Another object is to accomplish this in a construction which can be mass produced at low cost, and in which the various parts are disposable as a unit after use.

The novel garment of this invention comprises a body of flexible material, such as paper, fabric or plastic, and has a coating or strip of pressure-sensitive adhesive extending across its upper edge portion. To protect the adhesive until use, the garment is folded over upon itself, bringing the pressure-sensitive adhesive portions into contact with each other in a manner covering the same. For use, the folded garment is opened, exposing the adhesive layer which is placed generally against the wearer's clothing or body.

The foregoing and other objects, advantages and characterizing features of this invention will become apparent from the ensuing detailed description, taken in conjunction with the accompanying drawings wherein like reference numerals denote like parts throughout the various views.

THE DRAWINGS

FIG. 8 is a fragmentary perspective view similar to that of FIG. 1 but showing a modification;

FIG. 9 is a view similar to that of FIG. 2, but showing the modification of FIG. 8 and also illustrating how the adhesive-free upper side edge portions are pulled apart to open the garment for use;

FIG. 10 is a view like that of FIG. 3, but showing the modified form of FIG. 8;

FIG. 11 is a view like that of FIG. 8, but showing another modification;

FIG. 12 is a fragmentary perspective view, similar to that of FIG. 11 but showing the upper edge portion of the garment folded down upon itself, covering the adhesive, for use of the garment in the manner of a normal napkin;

FIG. 13 is a fragmentary perspective view of still another modified form; and FIG. 14 is a generally schematic, perspective view illustrating a possible production method and apparatus.

DESCRIPTION OF THE ILLUSTRATED EMBODIMENTS

Figures 1, 2, 3, 4, 5, 6, 7:
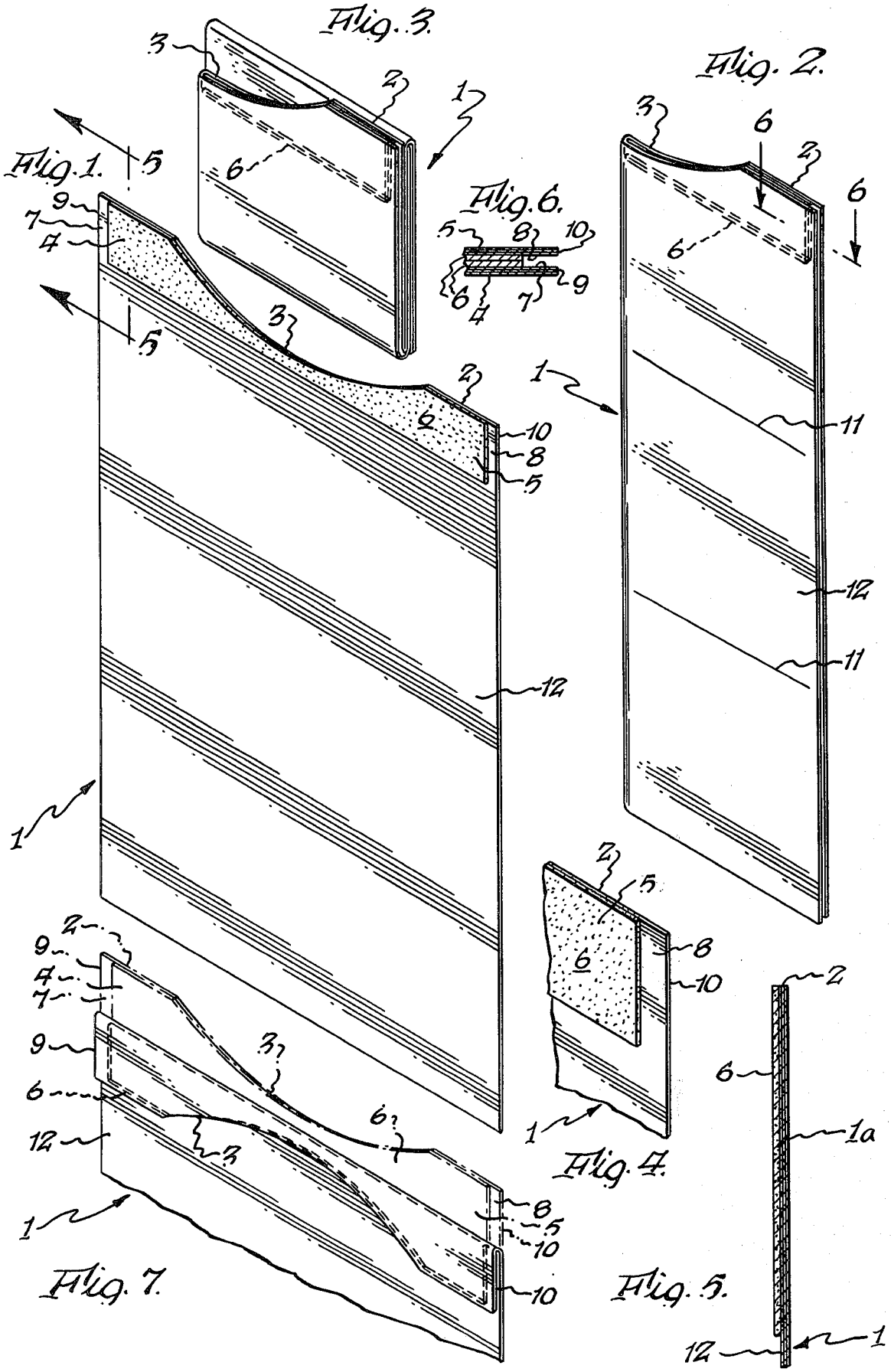
FIG. 1 is a perspective view of a protective garment of this invention, taken from the body side and showing the garment open, with the adhesive area exposed, ready for use.
FIG. 2 is a perspective view thereof, with the garment folded upon itself to protect the adhesive thereof.
FIG. 3 is a perspective view showing the garment in its fully folded condition, ready for packaging or storage prior to use.
FIG. 4 is a fragmentary, perspective, detail view showing one of the adhesive-free upper side edge portions.
FIG. 5 is a fragmentary sectional view on an enlarged scale, taken about on line 5—5 of FIG. 1.
FIG. 6 is a fragmentary, sectional, detail view taken about on line 6—6 of FIG. 2.
FIG. 7 is a fragmentary perspective view, similar to that of FIG. 1 but showing the upper edge portion thereof folded down upon itself, covering the adhesive for use of the garment in the manner of a regular napkin.

Referring first to the embodiment of FIGS. 1–7, there is shown a protective garment of flexible sheet material, generally designated 1, having an elongated, generally rectangular shape although it will be appreciated that other shapes may be employed when appropriate. Typically the garment body 12 is made of paper stock, for example the type of multi-ply stock used in conventional paper napkins, for economy and ease of disposal. However, cloth, plastic or other materials, alone or in various combinations may be used when the characteristics of such materials or combinations of materials make them advantageous or desirable for a particular purpose. The size of the garment will vary, depending upon its intended use, and particularly whether it is intended for use by children or by adults, and whether it is intended for use as a napkin, a bib or an apron, either mini or full size. In any case, the garment will be of a size such that, when it is opened, it will cover the area to be protected. For example, when open the garment may have a length of approximately twenty-six inches and a width of thirteen inches, or it may have a length of approximately nineteen and one-half inches and a width of approximately thirteen inches, both of which examples fold to an approximate six and one-half by six and one-half inch shape for convenient packaging and storage. These dimensions are by way of example only.

The upper edge 2 of garment 1 has a centrally located, shallow neck cutout portion 3 on opposite sides of which are side portions 4 and 5 adapted for attachment to the chest or front shoulder areas of the user. A layer 6 of pressure-sensitive adhesive extends across the upper edge portion of one side of the garment, extending in a substantially continuous manner almost completely thereacross, terminating slightly short of the opposite side edges of the garment, leaving those upper side edge portions adhesive free, as indicated at 7 and 8. In addition, the adhesive layer 6 extends from the upper edge 2 of the garment downwardly an appreciable distance, and extends below the neck cutout portion 3, as clearly shown in FIG. 1. In other words, the adhesive is coextensive with the upper edge portion of the garment, including cutout 3, excepting only side edge portions 7 and 8.

The area of adhesive is sufficient to provide an adequate surface for adhesion to the wearer's clothing or body, such that the garment will not become dislodged or tear loose from the wearer because of slight pulls, tugs or body movements such as might be encountered during normal use of the garment. Beyond this criterion, the width of adhesive layer 6, measured down from upper edge 2, may be selected for greatest economy and convenience in manufacture. Extending adhesive layer 6 substantially continuously across the upper edge portion of the garment, below and around neck cutout portion 3 and across side portions 4 and 5 substantially to the opposite side edges 9 and 10 provides an adhesive layer sufficient to give good adhesion, without tearing, and avoids gaps between the extreme side edge portions 7 and 8, which gaps might permit soiling of clothing intended to be protected. In general, a continuous film, strip or coating of adhesive having a width of one and one-half to two inches is believed to be satisfactory. Each adhesive-free area 7, 8 can be on the order of one-half inch, measured from the end of the adhesive layer 6 to the adjacent side edge 9, 10.

Pressure sensitive adhesive 6 can be of any suitable composition, selected to releasably adhere to itself and to the clothing or body of a user.

Prior to use it is important that the pressure-sensitive adhesive be covered, and not exposed, to prevent unwanted adhesion during handling, packaging and storage. It is a particular feature of this invention that the garment is self protecting in this respect, and does not require a separate protective strip or overlay. This is accomplished with the garment of my invention by folding the same about its center line, midway between and parallel to the opposite side edges 9 and 10, to the position shown in FIG. 2. When this is done, it will be seen that the left half portion of the adhesive layer 6 is folded over into contact with the right half portion thereof, whereby the adhesive layer 6 releasably adheres to itself and the garment body 12, to which the adhesive layer is applied, acts as a protective cover. The garment is then folded again, about fold lines 11 extending at a right angle to the opposite side edges 9, 10, to the compactly folded condition of FIG. 3 illustrating the garment ready for packaging or storage, prior to use. Body 12 of the garment covers and protects the adhesive 6, permitting the folded garment to be handled, packaged with others and stored, all without unwanted adhesion or other possible complications because of adhesive 6, which can be offset slightly below upper edge 2 if desired. If the open garment has the dimensions previously noted, in the folded condition of FIG. 3 it will measure only about six and one-half by six and one-half inches, a very convenient size.

When it is planned to use the garment, it is unfolded to the condition shown in FIG. 2. Then the upper side edge portions 7 and 8, which are not adhered together, are grasped and the garment halves pulled away from one another, opening the garment to the full open condition shown in FIG. 1 with adhesive layer 6 exposed and ready for application to the body or clothing of the wearer. The user then places neck cutout 3 below his chin, for central positioning of the garment on his chest and portions 4 and 5 will be in position for pressing against the user's garments. The bib then adheres to the wearer's person or clothing, by virtue of the pressure-sensitive adhesive which seals the area completely across the top of the bib, except for the extreme side edge portions which do not pose a problem. Since there is no portion of the bib which is behind the neck or shoulders, the arms or hands need not be stretched and little finger dexterity is required to position the garment. In use, the length of the napkin and the ability to fasten it high on the wearer's body give protection to a large area of the wearer's clothing from below the chin down across the lap area. The lower end of the bib or napkin can be picked up to wipe the mouth when desired, without becoming detached from the body, and whether this napkin is attached high or low on the wearer's body it will not slide off leaving the wearer's clothing unprotected. After use, the bib is easily pulled off and discarded, leaving no visible marks from the adhesive on the wearer's garments or clothing.

In those cases where, for whatever reason, it is desired not to adhere the protective garment to the wearer's clothing, the upper edge portion can be folded downwardly, from the position shown in phantom to that shown in full lines in FIG. 7. The adhesive layer 6 then adheres to the garment body material, and is covered, permitting the napkin to be used in the manner of an ordinary napkin with no adhesion whatever.

The adhesive 6 can be applied directly to the material of the body 12, or it can be applied to one face of a suitable film or tape the opposite face of which is adhered to the material of body 12. In either case, when the napkin body is made of a multiple ply paper, of a type in which the paper plies can be readily separated, an adhesive can be selected to penetrate and stiffen the plies of material against which it is applied. Looking at FIG. 5, if the pressure-sensitive adhesive is carried by a tape, then the tape can be secured to the paper plies by an adhesive which penetrates the plies of paper behind the tape as indicated at 1*a*, stiffening them and causing them to adhere to the tape and thereby resist pulling apart when the napkin is opened from the partially folded section shown in FIG. 2. Where the pressure-sensitive adhesive is applied directly to the material of body 12 it can be of the type which will penetrate the body material for this purpose, or a penetrating adhesive can be applied first and the pressure-sensitive adhesive applied thereover. In each case, the end result will be a paper napkin having several plies, but which can be opened by grasping the upper side edge portions 7 and 8 to separate the adhesive layer portions without the backing material of the napkin pulling away from the pressure-sensitive adhesive layer 6, thereby maintaining the integrity of the napkin as it is opened for use.

Turning now to the embodiment of FIGS. 8–10, the protective garment is generally indicated 1′. The body 12 of paper, plastic or whatever material or combination of materials is selected to comprise the napkin, carries a tape 13 which extends across the upper edge portion of the protective garment body, the upper edge of the tape coinciding with the upper edge 2 of the body, the garment has a central neck cutout portion 3 defining opposite side portions 4 and 5. Tape 13 extends to the opposite side edges 9, 10 of body 12 and a layer of pressure sensitive adhesive 6 extends, as before, substantially continuously across the upper edge portion and downwardly below the neck cutout portion, extending substantially completely across the upper edge portion and terminating just short of the opposite side edges 9′, 10′ of tape 13. This leaves the garment with adhesive-free upper side edge portions 7′ and 8′, as before. Tape 13 is secured to the upper edge portion of body 12 by a suitable adhesive which, when multiple ply paper is used for the napkin body, will penetrate the paper to stiffen it and assure the integrity of the napkin material when unfolded prior to use, as described above.

In operation, the embodiment of FIGS. 8–10 is like that of FIGS. 1–7. The napkin is folded upon itself about a center line parallel to the opposite side edges 9 and 10, bringing the opposite halves of the layer 6 into contact, thereby covering and protecting the adhesive layer. The napkin is thereafter folded about the fold lines 11 to the condition shown in FIG. 10, ready for packaging or storage.

When preparing the napkin for use, it is partially unfolded to the condition shown in FIG. 9 and the adhesive-free upper side edge portions 7′, 8′ are pulled apart to completely open the napkin and expose the adhesive. The napkin is applied to the body or clothing of the user and functions in the manner previously described.

Instead of providing adhesive on opposite sides of tape 13, the adhesive layer 6 being on one side and the adhesive for securing the tape to body 12 being on the other, the adhesive layer 6 can be used to secure the tape to the garment body. This is shown in FIGS. 11 and 12 wherein tape 13 projects above body 12 and is positively on the side thereof away from the user's body. The pressure-sensitive adhesive 6 along the bottom edge portion of tape 13 is brought into contact with the upper edge portion of the body material. In this way, only one side or face of the tape need have adhesive thereon, that being the pressure-sensitive adhesive 6 which secures the tape to the garment and thereafter secures the garment to the user. In this form, the upper edge 14 of the tape is the upper edge of the garment, and the neck recess 15 is cut out of the tape, leaving opposite side or shoulder portions 16 and 17.

As in the embodiment of FIGS. 1–7, if it is desired to use the garment in the manner of an ordinary napkin, the tape 13 is folded over to bring the adhesive layer 6 against the material of body 12, as shown in FIG. 12.

In another form of the invention, shown in FIG. 13, the adhesive layer extends over to the opposite side edges of the tape, as shown as 10′. To leave adhesive free portions at the opposite sides, to facilitate unfolding, the upper edge of the adhesive layer 6 is spaced slightly below the upper edge 14 of the tape, leaving adhesive free portions 18 across the upper edge portions of the side or shoulder portions of the garment on opposite sides of the neck cutout 15. The adhesive free portions 18 can be similar in width to the portions 8, 8′ and leave the upper portions of the garment on opposite sides, free for grasping in the manner described with reference to the other embodiments, to facilitate opening.

The goods or napkins of this invention can be mass produced by passing sheet material for garment body 12 from a roll 19 under a work station, as indicated in FIG. 14. Tape 13 is applied from a roll 20 along one edge of the sheet material, the tape 13 having a layer of adhesive 21 on the side being applied against the sheet material 12 for securing the tape to body 12. The pressure-sensitive adhesive can be applied by a segmented applicator 22 which will roll spaced apart strips of adhesive across the tape 13. The adhesive is delivered to applicator 22 from a glue pot or other supply 23 by a transfer applicator 24.

The sheet material is cut midway between adjacent adhesive strips 6, by a blade 25 on cylinder 26 driven in syncronism with applicator 22 via chain 27, leaving the adhesive-free opposite side edge portions when the material is cut or severed. The neck cutouts are made, and the material cut and folded, in appropriate sequence. Where the adhesive is simply applied directly to the material 12, that also can be done with the segmented applicator 22, or the adhesive can be applied by other means. For the embodiment of FIG. 13, the tape roll would be laterally offset, with adhesive for securing it to the napkin material applied only to the edge portion positioned to coincide with the edge portion of the body material.

Instead of spacing the adhesive strips, the adhesive can be applied in continuous strip form and thereafter treated or covered at spaced zones with a release agent or other material eliminating tack or adhesive qualities at those zones and thereby providing the adhesive-free side edge portions 7, 8 and 7′ and 8′. It is contemplated that the pressure sensitive adhesive will be of the type known as "light tack", and can be applied in strip, film or other forms.

Having disclosed and described my invention in certain presently contemplated forms, it will be understood that this is done by the way of illustration only and that the scope of my invention is intended to be defined by the appended claims.

What is claimed is:

1. A protective garment in the form of a bib, napkin or apron comprising a body of flexible sheet material having an upper edge and opposite side edges, a pressure sensitive adhesive capable of releasably adhering to itself and to the clothing or body of a user, said adhesive extending substantially continuously across the upper edge portion of said garment and downwardly from said upper edge for an appreciable distance, said garment having a gold line substantially parallel to and spaced from each of said opposite side edges and having the two portions thereof defined by said fold line in substantially overlying relationship, said garment having one portion of said adhesive contacting and overlying another portion of said adhesive whereby all of said adhesive is covered by said garment when the same is folded over upon itself prior to use, said garment having substantial areas without adhesive whereby said garment can be pulled apart to open said garment and expose said adhesive for placement against the clothing or body of a user.

2. The garment of claim 1, wherein said adhesive terminates short of the opposite side edges of said garment, leaving said side edge portions free of adhesive, to facilitate opening of the folded garment.

3. The garment of claim 2, wherein said upper edge portion of said garment has a central neck recess portion and shoulder portions on opposite sides thereof, said adhesive extending below said recess and across the major extent of said shoulder portions, leaving only a minor extent thereof adjacent said side edges free of adhesive.

4. The garment of claim 3, comprising a body of said sheet material and a tape extending across and secured to the upper edge portion of said body, said tape having a pressure-sensitive adhesive applied thereto.

5. The garment of claim 4, wherein said garment body is composed of plural plies of paper, and said tape is secured to said body by an adhesive penetrating said plies and stiffening the same.

6. The garment of claim 4, the upper edge of said tape substantially coinciding with the upper edge of said body.

7. The garment of claim 6, wherein said tape extends substantially to the opposite side edges of said body, and the opposite side edge portions of said tape are free of adhesive.

8. The garment of claim 6, wherein said tape terminates short of the opposite side edges of said body, whereby the upper side edge portions of said body are free of adhesive.

9. The garment of claim 4, wherein said tape projects above the upper edge of said body.

10. The garment of claim 9, wherein the lower edge portion of said tape is secured to the upper edge portion of said body, and said pressure-sensitive adhesive is applied to the face of said tape opposite said body.

11. The garment of claim 9, wherein said pressure-sensitive adhesive is applied to one face of said tape and secures said tape along its bottom edge portion to the upper edge portion of said body.

12. The garment of claim 1, wherein said upper edge portion of said garment has a central neck recess portion and shoulder portions on opposite sides thereof, and said adhesive extends below said recess and across said shoulder portions, the upper edge of said adhesive spaced slightly below the upper edge of said garment leaving the upper edge portions of said shoulder portions free of adhesive to facilitate opening of said garment.

13. The garment of claim 3, wherein said adhesive is applied directly to the material of said body.

14. The garment of claim 3, wherein said garment is of elongated, generally rectangular form when fully open, and said garment is folded about a center line substantially midway between and parallel to said opposite side edges to cover said adhesive and then folded at least once about a line substantially normal to said opposite side edges for packaging or storage prior to use.

15. A protective garment in the form of a bib, napkin, or apron comprising a body of flexible sheet material having an upper edge portion and opposite side edges, pressure sensitive adhesive carried by said upper edge portion of said garment and capable of releasably adhering to the clothing or body of a user, said garment having a fold line substantially parallel to and spaced from each of said opposite side edges and having the two portions thereof defined by said fold line in substantially overlying relationship, said adhesive releasably securing the adhesive-carrying portion of said garment when the same is folded over upon itself prior to use and with all of said adhesive covered by said folded garment, said garment having edge portions free of adhesive to facilitate unfolding said garment and thereby exposing said adhesive for placement against the clothing or body of a user.

16. The garment of claim 15, wherein said upper edge portion of said garment has a central neck recess portion and shoulder portions on opposite sides thereof, and said adhesive extends across said garment below said recess portion and on said shoulder portions.

17. The garment of claim 16, wherein said garment is folded about a fold line approximately midway between and parallel to said opposite side edges, and said adhesive is arranged on opposite sides of said fold line.

* * * * *